US009237607B2

(12) United States Patent
Pepin et al.

(10) Patent No.: US 9,237,607 B2
(45) Date of Patent: Jan. 12, 2016

(54) TEXTILE SYSTEM FOR PRODUCING HEAT

(71) Applicant: SOLENO TEXTILES TECHNIQUES INC., Laval (CA)

(72) Inventors: Francois Pepin, Beloeil (CA); Aldjia Begriche, Montreal (CA); Alain Poirier, St-Jean-sur-Richelieu (CA)

(73) Assignee: SOLENO TEXTILES TECHNIQUES INC., Laval (CA)

( * ) Notice: Subject to any disclaimer, the term of this patent is extended or adjusted under 35 U.S.C. 154(b) by 0 days.

(21) Appl. No.: 14/359,794

(22) PCT Filed: Nov. 21, 2012

(86) PCT No.: PCT/CA2012/050836

§ 371 (c)(1),
(2) Date: May 21, 2014

(87) PCT Pub. No.: WO2013/075238

PCT Pub. Date: May 30, 2013

(65) Prior Publication Data

US 2014/0326714 A1 Nov. 6, 2014

Related U.S. Application Data

(60) Provisional application No. 61/562,044, filed on Nov. 21, 2011.

(51) Int. Cl.

| | |
|---|---|
| ***H05B 3/08*** | (2006.01) |
| ***H05B 3/34*** | (2006.01) |
| ***H05B 1/02*** | (2006.01) |
| ***H05B 3/03*** | (2006.01) |

(52) U.S. Cl.
CPC ..... *H05B 3/342* (2013.01); *H05B 1/0272* (2013.01); *H05B 3/03* (2013.01)

(58) Field of Classification Search
USPC ..... 219/200–12, 217, 528–9, 541–9, 552–3
See application file for complete search history.

(56) References Cited

U.S. PATENT DOCUMENTS

| | | | | |
|---|---|---|---|---|
| 7,994,080 | B2 * | 8/2011 | Theort et al. | 442/377 |
| 2009/0051196 | A1 * | 2/2009 | Ishii et al. | 297/180.12 |

FOREIGN PATENT DOCUMENTS

| | | | |
|---|---|---|---|
| CA | 2761036 | A1 | 6/2012 |

* cited by examiner

*Primary Examiner* — Shawntina Fuqua
(74) *Attorney, Agent, or Firm* — Norton Rose Fulbright Canada LLP

(57) ABSTRACT

A textile system for producing heat comprises a panel of heating textile, the heating textile comprising a non-woven three-dimensional network of non-electrically conductive fibers and strands of electrically conductive fibers consolidated therewith. Electrodes are conductively connected to the panel of heating textile at opposite ends. A circuit is formed at least by the panel of heating textile and the electrodes, the circuit being adapted to be connected to a power source to heat the heating textile.

13 Claims, 2 Drawing Sheets

TEXTILE SYSTEM FOR PRODUCING HEAT

CROSS-REFERENCE TO RELATED APPLICATION

The present application claims priority on U.S. Provisional Patent Application No. 61/562,044, filed on Nov. 21, 2011 and incorporated herewith by reference.

FIELD OF THE APPLICATION

The present application relates to a textile system for producing heat, for use in human heating application, for instance in clothing or as a seat pad.

BACKGROUND OF THE ART

It is commonly known to heat textiles by passing an electric current through a circuit within a textile. For instance, heated blankets and jackets are commonly used. However, existing heated textiles typically comprise wires arranged in coil configurations, to produce the heat. The presence of such wires therefore may a negative impact on the practicality of the textile, for instance by adding rigidity and/or weight. Moreover, wires may be fragile and may be damaged by bending, and do not supply a homogeneous heat.

SUMMARY OF THE APPLICATION

It is therefore an aim of the present invention to provide a textile system for producing heat that addresses issues associated with the prior art.

Therefore, in accordance with the present application, there is provided a textile system for producing heat, comprising: a panel of heating textile, the heating textile comprising a non-woven three-dimensional network of non-electrically conductive fibers and strands of electrically conductive fibers consolidated therewith; electrodes conductively connected to the panel of heating textile at opposite ends; and a circuit formed at least by the panel of heating textile and the electrodes, the circuit being adapted to be connected to a power source to heat the heating textile.

Further in accordance with the present application, the electrodes are elongated electrodes and extend along opposite side edges of the panel.

Still further in accordance with the present application, each said electrode is made of a conductive wire.

Still further in accordance with the present application, the conductive wire of each said electrode is arranged in at least two elongated passes.

Still further in accordance with the present application, each said electrode comprises at least one copper wire.

Still further in accordance with the present application, each said electrode is sewn to the panel with a conductive thread.

Still further in accordance with the present application, sheathed wires are connected to the electrodes and adapted to be connected to the power source.

Still further in accordance with the present application, a power source connector is at the free end of the sheathed wires, the power source connector adapted to be releasably connected to the power source.

Still further in accordance with the present application, tacks are secured to the panel at ends of the electrodes connected to said sheathed wires.

Still further in accordance with the present application, the heating textile has an intrinsic resistivity ranging from 0.05 to 5.0 $\Omega m^2/kg$.

Still further in accordance with the present application, the panel has a surface ranging from 200 to 900 $cm^2$ for a 12V power source.

Still further in accordance with the present application, a pouch accommodates at least the panel and the electrodes.

Still further in accordance with the present application, a 12V battery is the power source.

Still further in accordance with the present application, the strands have a length ranging between 2.5 cm and 15.3 cm.

DESCRIPTION OF THE PREFERRED EMBODIMENTS

Figure 1:
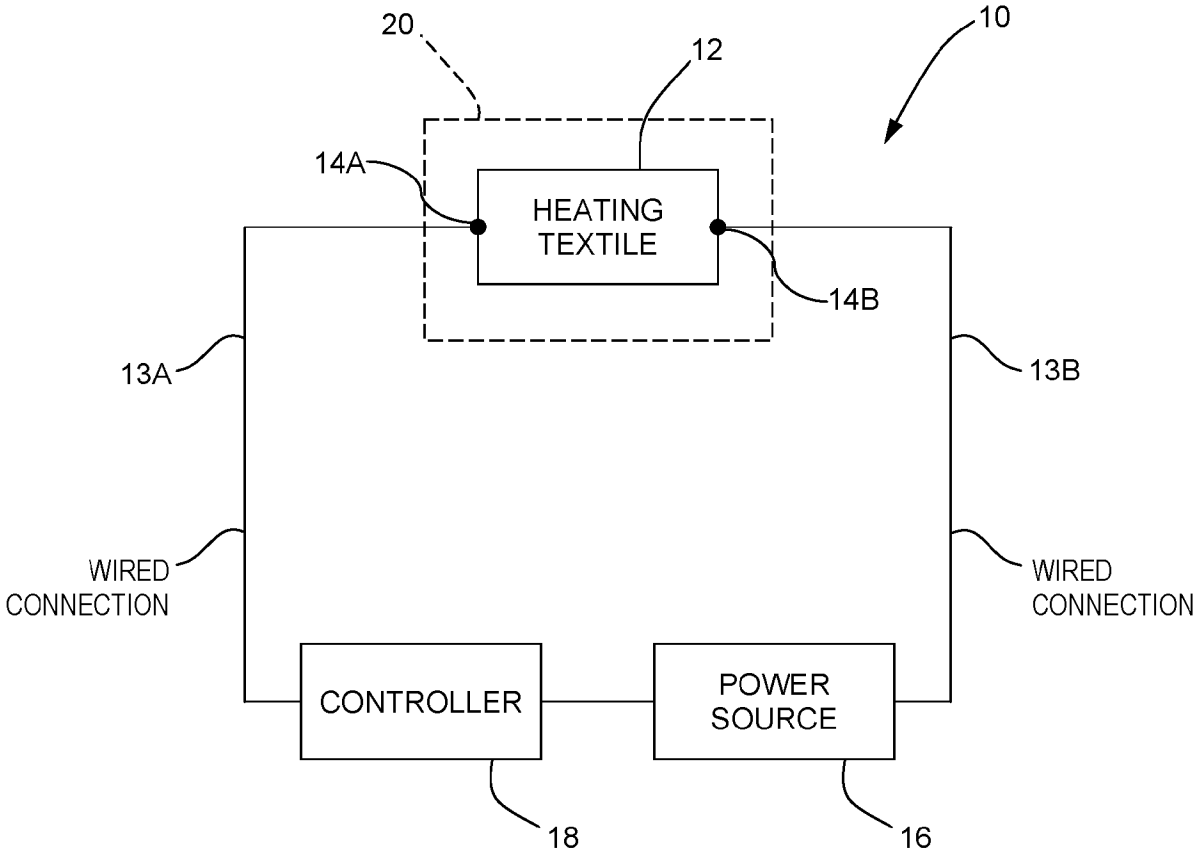
FIG. 1 is a block diagram of a textile system for producing heat in accordance with an embodiment of the present disclosure.
Figure 2:
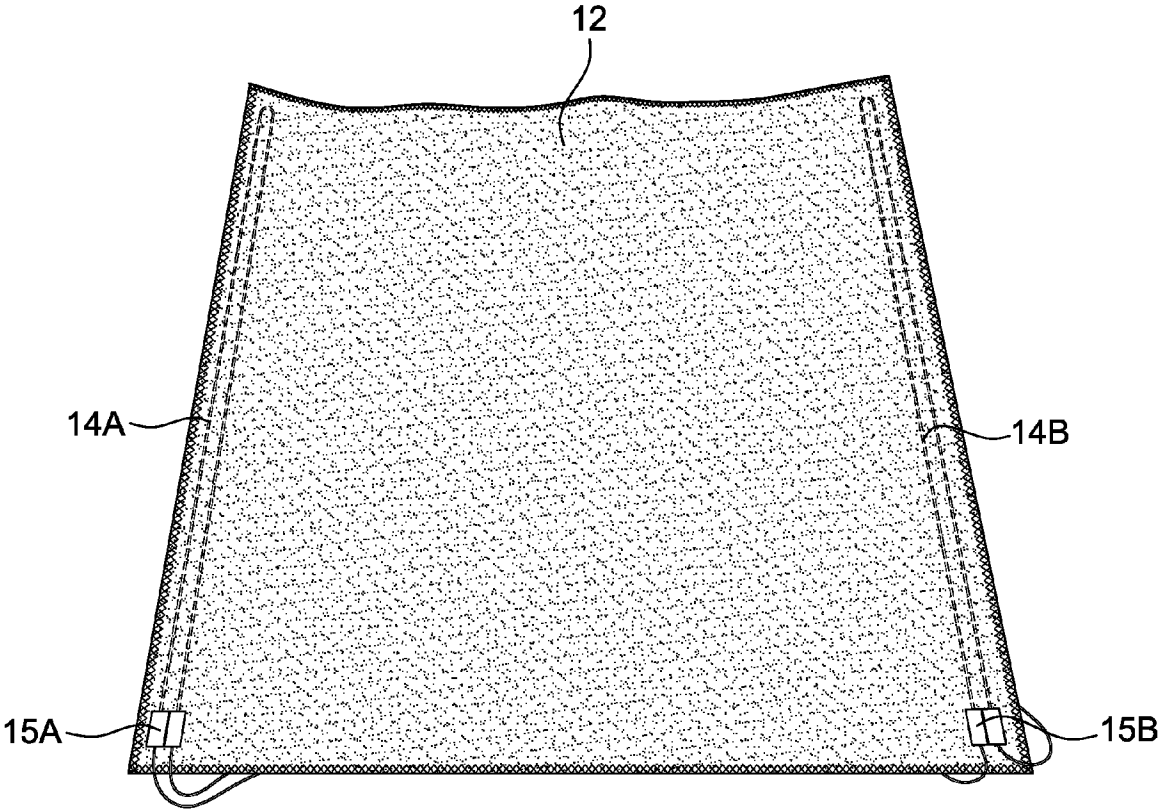
FIG. 2 is a schematic view of a heating textile of the textile system of FIG. 1.

Referring to FIGS. 1 and 2, there is illustrated a textile system for producing heat at 10. The textile system 10 comprises a panel of heating textile 12. The heating textile 12 is of the type receiving an electric current to produce heat.

According to an embodiment, the heating textile 12 is in accordance with the fabric described in U.S. Pat. No. 7,994,080, incorporated herewith by reference, or in accordance with any other suitable configuration. Therefore, the panel of heating textile 12 may be an electrically conductive non-woven fabric comprising a three-dimensional network of non-electrically non-woven conductive fibers and electrically conductive strands of synthetic or metallic fibers consolidated therewith. The conductive strands may have a length ranging between 2.5 cm and 15.3 cm, although the conductive strands may be longer. According to an embodiment, the non-electrically conductive synthetic fibers occupy a mass ranging between 50% to 98% of the fabric such that the fabric has an intrinsic resistivity in the range of from about 0.05 to 5.0 $\Omega m^2/kg$. In this embodiment, the electric current is conducted through the panel of heating textile 12 without a full circuit of wires all over the textile 12. In other words, the heating textile 12 is the link between the electrodes 14A and 14B. Accordingly, the properties of the panel of heating textile 12 are similar to that of more conventional fabrics in terms of lightness and flexibility.

Wires 13A and 13B are part of a circuit that will supply electric current to the heating textile 12. As shown in FIG. 2, a portion of the wires 13A and 13B are fixed directly to the heating textile 12, at opposed ends of the panel, and hence form electrodes 14A and 14B for the heating textile 12. The electrodes 14A and 14B are for instance sewn to the heating textile 12 in the illustrated elongated pattern. In an embodiment, a conductive sewing thread (e.g., silver or the like) is used to attach the electrodes 14A and 14B to the heating textile 12. The electrodes 14A and 14B may consist of any suitable conducting material, such as a copper wire, and may be arranged in a few passes (two in FIG. 2) to have suitable conducting surface with the heating textile 12. The spacing between the electrodes 14A and 14B causes the electric current to pass through the heating textile 12 when the circuit is closed. The resistivity of the heating textile 12 will cause same to heat up when electric current passes through it.

As shown in FIG. 2, tacks 15A and 15B may respectively be provided in the wires 14A and 14B, to secure wires 14A and 14B to the heating textile 12. The electrodes 14A and 14B may be directly linked to the panel of heating textile 12. The tacks 15 are patches of material sewn to the heating textile 12, to reinforce the joint between the electrodes 14A and 14B and the heating textile 12. The wires 13A and 13B may be sheathed from the tacks 15A and 15B to a power source 16. The electrodes 14A and 14B may be directly linked to the panel of heating textile 12, and may also be covered by a strip of sheathing, or encapsulated for instance by folded edges of the heating textile 12.

Referring to FIG. 1, a power source 16 is in the circuit of the system 10. Considering that the textile system 10 is used in garment and human heating applications, the power source 16 may be a lower voltage unit, such as a battery for portable applications. Appropriate connectors are provided as a function of the type of battery used. It is also considered to provide the system 10 with a connector plug, such as car lighter connector. A controller 18 may be provided to adjust the level of current fed to the circuit. In its basic configuration, the controller 18 is an on/off switch to open and close the circuit. The controller 18 may be a rheostat, and may include a digital-display thermostat and thermocouple to control the temperature of the heating textile 12.

According to an embodiment, the system 10 is used in relatively low voltage applications, in portable configuration. By way of example, standard 12V batteries or like 12V power sources are used as power source 16. For the intrinsic resistivity in the range of from about 0.05 to 5.0 $\Omega m^2/kg$ for the heating textile 12, panels sized between 200 and 900 $cm^2$ can be used with the 12V source to produce heat in a temperature ranging between 30° C. and 45° C., i.e., suitable for heating bodily parts without risk of burning. However, all necessary precautions must be taken to avoid overheating and prevent hazards and/or injuries. For instance, any appropriate electronic component may be added to the circuit of the system 10 to prevent such issues, such as limit switches, fuses, etc.

The panel of heating textile 12 could be positioned within a garment or pouch 20. According to an embodiment, the panel of heating textile 12 is inserted in a pouch and is used as a cushion, or transportable seating pad. Due to the nature of the heating textile 12, for instance because the conductive elements are fibers and are therefore flexible, the heating textile 12 may be folded, rolled up, bent, without the risk of kinking conductive wires. Precautions must however be taken to protect the electrodes 14A and 14B, for instance so as not to cause a short circuit. According to another embodiment, the garment 20 is a jacket, with suitable space to accommodate the panel of heating textile 12. In both cases, the garment or pouch 20 is designed to facilitate access or support the other components of the circuit.

The invention claimed is:

1. A textile system for producing heat, comprising:

a panel of heating textile, the heating textile comprising a non-woven three-dimensional network of non-electrically conductive fibers and strands of electrically conductive fibers consolidated therewith;

electrodes conductively connected to the panel of heating textile at opposite ends, the electrodes each being a conductive thread sewn through the non-woven three-dimensional network of the panel; and a circuit formed at least by the panel of heating textile and the electrodes, the circuit being adapted to be connected to a power source to heat the heating textile.

2. The textile system according to claim 1, wherein the electrodes are elongated electrodes and extend along opposite side edges of the panel.

3. The textile system according to claim 1, wherein each said electrode is made of a conductive wire.

4. The textile system according to claim 3, wherein the conductive wire of each said electrode is arranged in at least two elongated passes.

5. The textile system according to claim 1, wherein each said thread comprises at least one copper wire.

6. The textile system according to claim 1, further comprising sheathed wires connected to the electrodes and adapted to be connected to the power source.

7. The textile system according to claim 6, further comprising a power source connector at the free end of the sheathed wires, the power source connector adapted to be releasably connected to the power source.

8. The textile system according to claim 6, further comprising tacks secured to the panel at ends of the electrodes connected to said sheathed wires.

9. The textile system according to claim 1, wherein the heating textile has an intrinsic resistivity ranging from 0.05 to 5.0 $\Omega m^2/kg$.

10. The textile system according to claim 1, wherein the panel has a surface ranging from 200 to 900 $cm^2$ for a 12V power source.

11. The textile system according to claim 1, further comprising a pouch accommodating at least the panel and the electrodes.

12. The textile system according to claim 1, further comprising a 12V battery as the power source.

13. The textile system according to claim 1, wherein the strands have a length ranging between 2.5 cm and 15.3 cm.

* * * * *